US005888059A

United States Patent [19]

Edwards et al.

[11] Patent Number: 5,888,059

[45] Date of Patent: Mar. 30, 1999

[54] COMBUSTION APPARATUS

[75] Inventors: Jeffrey Charles Edwards, Aberdeen; Gordon Petrie, Arbroath, both of United Kingdom

[73] Assignee: Expro North Sea Limited, Scotland

[21] Appl. No.: 950,537

[22] Filed: Oct. 15, 1997

Related U.S. Application Data

[63] Continuation of Ser. No. 688,550, Jul. 30, 1996, abandoned, which is a continuation of Ser. No. 411,769, filed as PCT/GB93/01128, May 28, 1993, abandoned.

[30] Foreign Application Priority Data

Oct. 1, 1992 [GB] United Kingdom ..... 9220710

[51] Int. Cl.[6] ..... F23M 3/00

[52] U.S. Cl. ..... 431/9; 431/173; 431/350; 239/403

[58] Field of Search ..... 431/202, 254, 431/7, 10, 9, 190, 181; 239/403, 405, 429, 430, 437; 110/213

[56] References Cited

U.S. PATENT DOCUMENTS

| | | | |
|---|---|---|---|
| 3,124,086 | 3/1964 | Sage et al. | 110/213 |
| 3,894,831 | 7/1975 | Glotin et al. | 431/202 |
| 3,897,007 | 7/1975 | Roy | 239/403 |
| 4,419,071 | 12/1983 | Schwartz | 431/202 |
| 4,687,436 | 8/1987 | Shigeta | 431/173 |
| 5,322,222 | 6/1994 | Lott | 239/403 |

FOREIGN PATENT DOCUMENTS

| | | | |
|---|---|---|---|
| Wo 84/01421 | 4/1984 | WIPO | 431/202 |

*Primary Examiner*—James C. Yeung
*Attorney, Agent, or Firm*—Gifford, Krass, Groh, Sprinkle, Anderson & Citkowski, P.C.

[57] ABSTRACT

An apparatus for burning crude oil has a conduit (12) without a flow restriction orifice and which receives oil to be burned. The conduit (12) has a plurality of inclined nozzles (28) which are also arranged about the longitudinal axis of the bore (30) so as to be substantially tangential to the interior surface. A supply of high velocity air is passed through an inlet manifold (32) and inside a housing (18) surrounding the conduit (12) in the vicinity of the nozzles (28) where it passes through the nozzles (28) into the bore (30) of the conduit (12). The high velocity air breaks the fuel up into particles and pounds the particles with an angular velocity causing the particles to swirl or rotate as a fine mist in one direction about the longitudinal axis at the outlet (16).

14 Claims, 2 Drawing Sheets

COMBUSTION APPARATUS

This is a continuation of application Ser. No. 08/688,550 filed on Jul. 30, 1996, abandoned which is a continuation of Ser. No. 08/411,769, filed on May 12, 1995, abandoned, International Application PCT/GB93/01128 filed on May 28, 1993 and which designated the U.S.

This present invention relates to a method and apparatus, particularly, but not exclusively, for burning crude oil on oil exploration and production platforms. In particular the invention relates to an oil burner for burning crude oil obtained from well testing operations. The invention also relates to a burner for burning other carbonaceous fossil fuels in liquid or particulate form, such as coal dust.

On exploration platforms there is no facility for disposing of oil obtained from well testing platforms. Consequently this oil is disposed of by burning the oil at the extremity of a boom.

Most existing crude oil burners use traditional furnace technology. This involves initially atomising oil by creating a pressure drop across an orifice and then mixing the atomised oil with propellant such as air or gas. The mixture is then injected through a further nozzle and then ignited. Combustion is often inefficient and incomplete resulting in the production of an excessive amount of black smoke which is not only hazardous but is environmentally damaging. In addition, if the crude oil is viscous or contains a high solid content, the nozzles can become fully or partially blocked so that combustion is incomplete.

An object of the present invention is to provide improved combustion apparatus and a method of combustion which obviates or mitigates at least one of the disadvantages associated with existing combustion apparatus.

This is achieved by providing a combustion apparatus which efficiently mixes a flowable carbonaceous fossil fuel with a gaseous-type propellant and retains the mixture in the combustion area longer to facilitate more efficient combustion. In one arrangement this is done by providing high velocity air flow to the burner head simulating the behaviour of an aerosol or paint gun.

In a preferred arrangement this is achieved by providing combustion apparatus in the form of a burner head in which oil is passed through a conduit without a restriction orifice. Near the end of the conduit are disposed a plurality of apertures each of which are inclined towards the conduit outlet and which pass through the conduit such that they are substantially tangential to the surface of the conduit, and surrounding the conduit in the vicinity of the inclined apertures in an annulus and air of high velocity is passed through the annulus and through the inclined apertures into the interior of the conduit to mix with the oil. The air breaks up the oil into particles and provides the particles with angular velocity causing them to rotate or swirl in one direction. This swirling mixture stays in the flame which gets hotter as more particles are consumed so that the combustion is improved.

The agitation of the oil produces a fine swirling mist at the burner exit throat and comparative flow tests on this burner relative to a conventional head have been successful and have produced virtually no visible emissions.

According to one aspect of the present invention there is provided combustion apparatus comprising a conduit for receiving a flowable carbonaceous fossil fuel to be combusted, the conduit having a bore, an inlet, an outlet and a longitudinal axis, a housing surrounding the said conduit and defining a space between an interior surface of the housing and an exterior surface of the conduit, the conduit having a plurality of apertures therein connecting the bore of the conduit with the space, said apertures being angled or inclined to the longitudinal axis of the conduit and directed towards the conduit outlet and being disposed such that the nozzles having an outlet in the bore substantially tangential to the interior surface of the conduit, said housing being adapted to be coupled to a gaseous supply so that, in use, when the fuel flows through the conduit towards an outlet, a high pressure gas is forced around said space and through said inclined apertures to produce a swirling mixture of fuel particles for combustion at the outlet of said conduit.

Preferably, said set of apertures are disposed in a plane substantially perpendicular to the longitudinal axis of the conduit.

Conveniently, said apertures are arranged in a spiral around the conduit. Advantageously, the fuel is oil such as crude oil. Alternatively, the fuel is coal dust.

According to another aspect of the present invention there is provided combustion apparatus for mixing a flowable carbonaceous fossil fuel with a gaseous propellant comprising a burner head having a conduit for receiving a supply of fuel to be burned, said conduit having no restriction orifice, an inlet, an outlet, a bore and a longitudinal axis, said conduit also having a plurality of nozzles disposed near the conduit outlet for permitting passage of a high velocity gaseous propellant into the bore of the conduit for mixing with fuel therein, a housing surrounding said conduit and defining a space with the outer surface of said conduit for directing said high velocity gaseous propellant around the outer surface of said conduit, a gaseous propellant inlet conduit coupled to said housing for allowing gaseous propellant to be fed into said housing, said nozzles in said conduit extending through the conduit to connect the space between the housing and the conduit space with the bore of said fuel conduit, said nozzles being inclined to the longitudinal axis of said fuel conduit in the direction of flow and being arranged such that each nozzle passes through the conduit such that the nozzle exits into the bore substantially at a tangent to the surface of the bore, said nozzles being spaced around the periphery of said fuel conduit whereby, in use, fuel which is fed through the bore of said fuel conduit is subjected to high velocity gaseous propellant which breaks up the fuel into particles and provides the particles with angular momentum causing the particles to swivel or rotate so as to create a swirling mist at the burner exit throat.

According to a further aspect of the present invention there is provided a method of burning a flowable carbonaceous fossil fuel in a fuel burner comprising the steps of, passing fuel to be burned along a conduit without a flow restricting orifice, said conduit having an inlet, an outlet, a bore and a longitudinal axis, passing a gaseous propellant through a plurality of nozzles into the bore of the conduit near the conduit outlet, the nozzles in the bore being inclined to said longitudinal axis of the conduit and passing through the bore such that each nozzle exits in the bore at a location substantially tangential to the interior surface of the conduit, mixing the gaseous propellant with the fuel in said conduit so that said gaseous propellant breaks the fuel up into particles having an angular velocity resulting in the particles swirling or rotating in a mist about the longitudinal axis of the conduit in one direction at the outlet of the conduit igniting the mixture at the conduit outlet.

These and other aspects of the invention will become apparent from the following description and taken in combination with the accompanying drawings in which.

Figure 1:
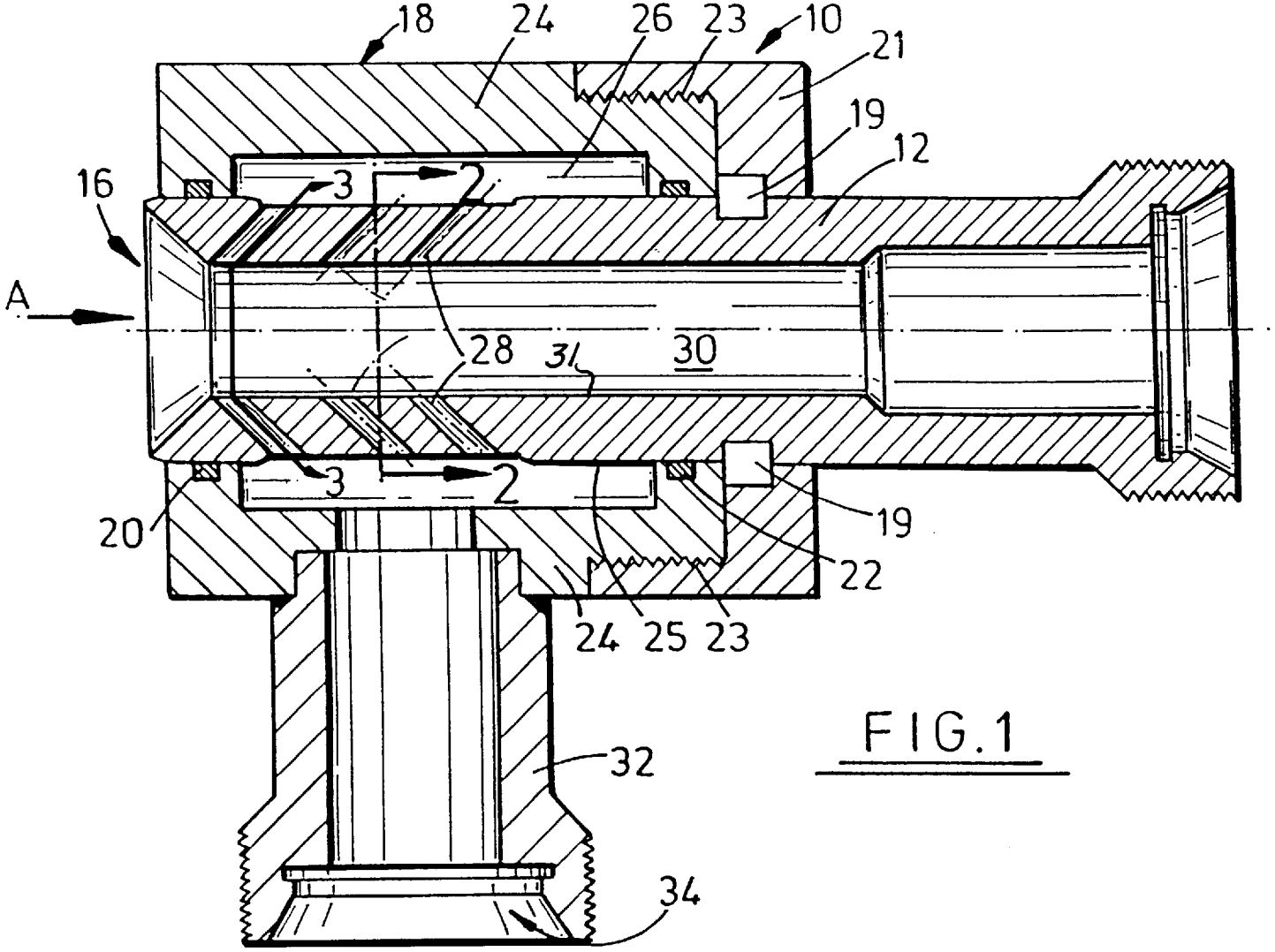
FIG. 1 is a cross-sectional view taken through an oil burner head in accordance with an embodiment of the present invention.
Figure 2:
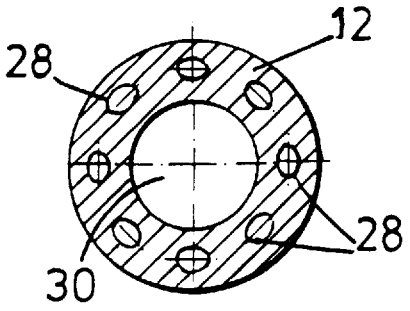
FIG. 2 is a cross-section view taken on the line 2—2 of FIG. 1.
Figure 3:
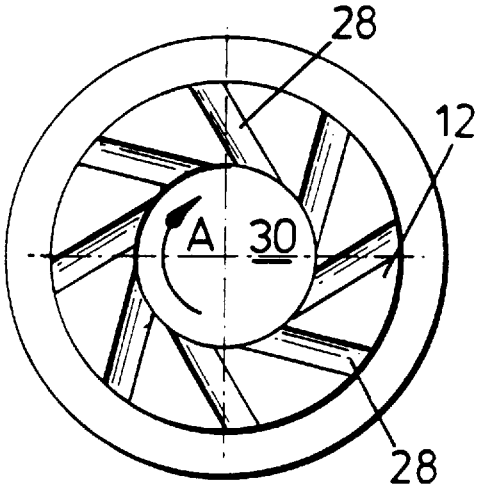
FIG. 3 is an end view of the burner taken in the direction of arrow A shown in FIG. 1 along the lines 3—3.
Figure 4:
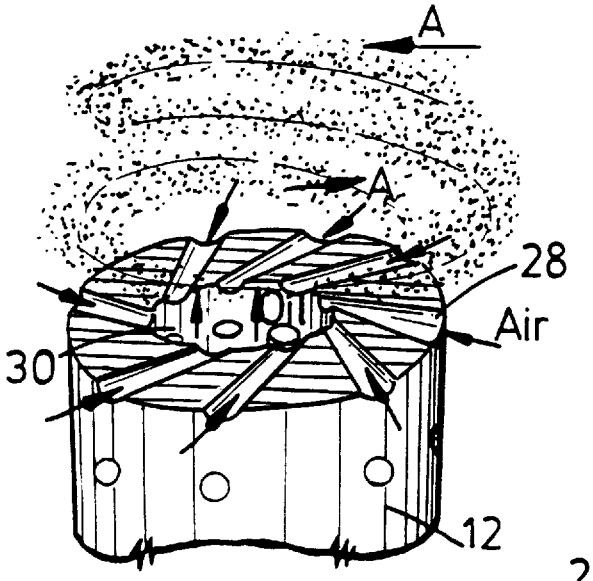
FIG. 4 is a perspective and partly broken away view of the conduit of FIGS. 1, 2 and 3 without the housing.

Reference is first made to FIG. 1 of the drawings which depicts a burner head generally indicated by reference numeral 10 for burning crude oil either on-shore of off-shore. It will be appreciated that a single or a plurality of such burner heads can be used but a single burner head will be described in the interests of clarity. The burner head 10 consists of a steel cylindrical conduit 12 which has an inlet 14 for coupling to a source of well-oil (not shown in the interests of clarity) and a burner outlet 16 where the oil fed to the burner is ignited by a pilot light (not shown) and burned off as will be later described in detail. A cylindrical housing generally indicated by reference numeral 18 is disposed around the exterior of the tubular conduit 12 and is in sealing engagement therewith by virtue of O-ring seals 20 and 22. The housing 18 is held in place by split-ring 19 and collar 21 which is connected to the housing 18 by threaded coupling 23. The housing wall 24 defines, with the exterior wall 25 of the tubular conduit 12 an annular chamber generally indicated by the reference numeral 26. A plurality of angled nozzles 28 are disposed in the wall of the cylindrical conduit 12 to provide communication between the annular chamber 26 and the bore 30 of the conduit. In the embodiment shown there are 24 nozzles arranged in 3 groups of 8 spaced 45° apart around the circumference of the conduit 12 as best seen in FIGS. 2, 3 and 4 although in FIG. 1 only 6 such nozzles are shown. Each nozzle 28 is a drilled hole ¼" in diameter and is angled at about 45° to the bore axis and the direction of flow of the oil and, as best seen in FIGS. 3 and 4, the nozzles are arranged so that they pass through the conduit 12 non-radially with the apertures exiting in the bore 30 substantially at a tangent to the internal bore surface 31. This orientation of the apertures facilitates passage of high velocity air from the annular chamber 26 to the bore of the cylindrical conduit 30 to facilitate combustion as will be later described in detail. The housing 18 is coupled to an air inlet manifold 32 which, in turn, has an inlet 34 which is coupled to a supply of high velocity air (not shown in the interests of clarity). The inlet manifold 32 may be coupled to the housing 18 by means of a threaded connection or snap release coupling or any other suitable means for connecting coupling units.

With reference to FIGS. 2 and 3 it will be seen that the nozzles 28 are spaced evenly around the periphery of the conduit 12 to facilitate air flowing evenly into the conduit for thorough and even mixing of the oil for burning.

In use, oil is passed to the burner head 10 and is passed through the bore 30 of the conduit 12. As the oil approaches the outlet 16 it is mixed with high velocity air which passes through the manifold 32 around the annulus 26 and through the nozzles 28 where it mixes with the oil to provide a swirling vortex-like oil/air mixture in the form of a mist in one direction as best seen by the arrows in FIGS. 3 and 4. The swirling mixture mist provides efficient mixing such that the mixture, once ignited, stays in the flame longer, becomes hotter and provides thorough and efficient combustion of the crude oil so that there is virtually no visible emissions obtained.

This device provides results far superior to existing burner heads and it will be appreciated that the plurality of such burner heads can be combined to provide a composite burner head to handle larger flows of crude oil. The group of nozzles have the advantage that they produce a swirling oil/air mixture mist which is very thorough and efficient with the result that the mixture stays in the flame longer so that the temperature of the flame increases. This in time, results in complete and efficient combustion of the crude oil to such an extent that virtually all sooty or black smoke emissions are avoided as the crude oil is completely combusted.

Figure 5:
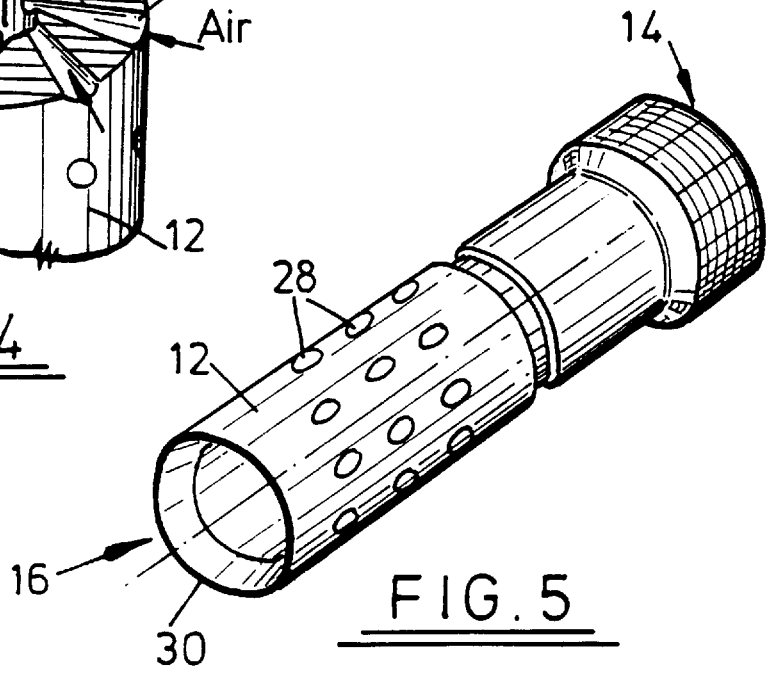
FIG. 5 is a conduit for use with the burner with an alternative arrangement of nozzles to those in FIGS. 1 to 4.

Various modifications may be made to the embodiment hereinbefore described without departing from the scope of the invention. For example, any number of nozzles can be disposed in the burner head sufficient to provide a sufficient flow of air to ensure proper mixing and achieve a necessary swirling vortex-like effect. The nozzle size and angle is not critical and may be varied from that shown in the drawing. However, the nozzle size and angle should still be sufficient to permit air to mix with the oil as before described and ensure a swirling mixture. The nozzles can be arranged in groups in planes perpendicular to the longitudinal axis or can be arranged in a continuous or discontinuous spiral on the conduit as shown in FIG. 5 to facilitate creation of a spiral swirling mixture mist. It will also be understood that gaseous propellants other than air, for example, steam or hydrocarbons, may be used as long as it achieves the necessary mixing with the oil to facilitate combustion as aforedescribed. It will be understood that nozzles 28 do not have to enter bore 50 at an exact tangent to the surface; they should enter at a sufficient angle so that, in use, when the high velocity gaseous propellant passes through the nozzles then a swirling mixture mist of oil particles, coal dust is created as shown in FIG. 4. The burner can cope with higher water cut crude and heavy crudes. The fuel can also be particulate flowable fossil fuel such as coal dust which can be mixed with the high velocity gaseous propellant to create a swirling mist of coal dust particles for combustion at the burner.

The principle advantage of the present invention is that combustion of the crude oil is achieved without producing sooty black smoke; the burning is very efficient and there are virtually no visible emissions resulting from the combustion resulting in less immediate environmental impact. There is no need to throttle the oil flow to the burner so that the risk of blockage even with crude oil with a high solid content or with particulate fuel such as coal dust is minimised.

Another advantage offered by this system is the reduction of back pressure created by the orifices used in conventional burners, thus enabling wells to be tested without restriction. This means that the well-test system operating pressure can be reduced which has a safety advantage in that the risk of hydrocarbon back-flow into the atomising air system is decreased.

We claim:

1. Combustion apparatus comprising a conduit for receiving a flowable carbonaceous fossil fuel to be combusted, the conduit having a bore, an inlet, and outlet and a longitudinal axis, a housing surrounding said conduit and defining a space between an interior surface of the housing and an exterior surface of the conduit, the conduit having a plurality of apertures therein connecting the bore of the conduit with the space, said apertures being angled to the longitudinal axis of the conduit and directed towards the conduit outlet and being disposed such that the apertures each have an outlet in the bore substantially tangential to the interior surface of the conduit, said apertures being arranged as a plurality of sets disposed along the longitudinal axis of the conduit, said housing being adapted to be coupled to a gaseous supply so that, in use, when the fuel flows through the conduit towards an outlet, a high pressure gas is forced around said space and through said angled apertures to produce a swirling mixture of oil particles for combustion at the outlet of said conduit.

2. Combustion apparatus as claimed in claim 1 wherein said sets of said plurality of apertures are disposed in a plane substantially perpendicular to the longitudinal axis of the conduit.

3. Combustion apparatus as claimed in claim 1 wherein said apertures are arranged in a spiral around the conduit.

4. Combustion apparatus as claimed in claim 1 wherein said conduit is cylindrical.

5. Combustion apparatus as claimed in claim 1 wherein said housing is cylindrical.

6. Combustion apparatus as claimed in claim 1 wherein said space is an annulus.

7. Combustion apparatus as claimed in claim 4 wherein said angled apertures are nozzles disposed evenly about the periphery of said cyndrical conduit.

8. Combustion apparatus as claimed in claim 7 wherein five sets of nozzles are spaced along the longitudinal axis of the conduit.

9. Combustion apparatus as claimed in claim 8 wherein there are eight nozzles in each set.

10. Combustion apparatus for mixing a flowable carbonaceous fossil fuel with a gaseous propellant comprising a burner head having a conduit for receiving a supply of fuel to be burned, said conduit having no restriction orifice, an inlet, an outlet, a bore and a longitudinal axis, said conduit also having a plurality of nozzles disposed near the conduit outlet for permitting passage of a high velocity gaseous propellant into the bore of the conduit for mixing with fuel therein, a housing surrounding said conduit and defining a space with an outer surface of said conduit for directing said high velocity gaseous propellant around the outer surface of said conduit, a gaseous propellant inlet conduit coupled to said housing for allowing gaseous propellant to be fed into said housing, said nozzles in said conduit extending through the conduit to connect the space between the housing and the conduit space with the bore of said fuel conduit, said nozzles being inclined to the longitudinal axis of said fuel conduit in the direction of flow and being arranged such that each nozzle passes through the conduit such that the nozzle exits into the bore substantially at a tangent to the surface of the bore, said nozzles being spaced around the periphery of said fuel conduit whereby, in use, fuel which is fed through the bore of said fuel conduit is subjected to high velocity gaseous propellant which breaks up the fuel into particles and provides the particles with angular momentum causing the particles to swivel or rotate so as to create a swirling mist at the burner exit throat.

11. Combustion apparatus as claimed in claim 10 wherein the gaseous propellant is air.

12. Combustion apparatus as claimed in claim 10 wherein a group of said plurality of nozzles are arranged in a plane substantially perpendicular to said conduit longitudinal axis of said conduit.

13. Combustion apparatus as claimed in claim 10 wherein said nozzles are arranged in a spiral around said conduit.

14. A method of burning a flowable carbonaceous fossil fuel in a fuel burner comprising the steps of, passing the fuel to be burned along a conduit without a flow restricting orifice, said conduit having an inlet, an outlet, a bore and a longitudinal axis, passing a gaseous propellant through a plurality of nozzles into the bore of the conduit near the conduit outlet, the nozzles in the bore being inclined to said longitudinal axis of the conduit and passing through the bore such that each nozzle exits in the bore at a location substantially tangential to the interior surface of the conduit, mixing the gaseous propellant with the fuel in said conduit so that said gaseous propellant breaks the fuel up into particles having an angular velocity resulting in the particles swirling or rotating in a mist about the longitudinal axis of the conduit in one direction at the outlet of the conduit igniting the mixture at the conduit outlet.

* * * * *